US009638068B2

(12) United States Patent
Sinatov et al.

(10) Patent No.: US 9,638,068 B2
(45) Date of Patent: May 2, 2017

(54) ENERGY STORAGE AND RECOVERY METHODS, SYSTEMS, AND DEVICES

(71) Applicant: MADA ENERGIE LLC, New York, NY (US)

(72) Inventors: Stanislav Sinatov, Kiryat-Ono (IL); Leon Afremov, Tel Aviv (IL)

(73) Assignee: MADA ENERGIE LLC, New York, NY (US)

( * ) Notice: Subject to any disclaimer, the term of this patent is extended or adjusted under 35 U.S.C. 154(b) by 271 days.

(21) Appl. No.: 14/565,410

(22) Filed: Dec. 9, 2014

(65) Prior Publication Data

US 2015/0218968 A1 Aug. 6, 2015

Related U.S. Application Data

(60) Provisional application No. 61/913,773, filed on Dec. 9, 2013.

(51) Int. Cl.
*F01K 27/00* (2006.01)
*F01K 3/18* (2006.01)

(52) U.S. Cl.
CPC ..... *F01K 27/00* (2013.01); *F01K 3/18* (2013.01)

(58) Field of Classification Search
CPC ..... F01K 27/00; F01K 3/18
USPC ..... 60/653, 659, 677–680
See application file for complete search history.

(56) References Cited

U.S. PATENT DOCUMENTS

| | | | | |
|---|---|---|---|---|
| 8,627,665 | B2 * | 1/2014 | Ruer | F01K 3/12 60/650 |
| 2011/0023476 | A1 * | 2/2011 | Havel | F01K 3/00 60/407 |
| 2011/0100010 | A1 * | 5/2011 | Freund | F02C 1/005 60/659 |
| 2012/0312496 | A1 * | 12/2012 | Howes | F01K 3/12 165/7 |
| 2013/0042601 | A1 * | 2/2013 | Kraft | F15B 1/022 60/327 |

* cited by examiner

*Primary Examiner* — Hoang Nguyen
(74) *Attorney, Agent, or Firm* — Potomac Law Group, PLLC; Mark Catan

(57) ABSTRACT

A method for energy storage and recovery is based on the liquid air energy storage (LAES) operated at the pressure relationship such that the pressure of discharge air is greater than the charge air to provide a high round-trip efficiency. External cold source and cold thermal energy storage are used in a LAES to achieve a decrease in the LAES capital costs. A demand for a supplemental cold energy provided by external sources may be minimized. These features alone or in combination may result in reduced power demand required for cooling.

20 Claims, 8 Drawing Sheets

LAES System
Air Inlet
Reverse Air Stream
AC
AE
Heat Storage
Balance Cold Generator
Power
Appropriate Cold Carrier
Throttling Device
Gas
Liquid
Air Separator
Balance CEX
Cold Storage 2
CEX 2
CEX 3
Cold Storage 3
Liquid Air Pump
Liquid Air Storage
Filter
Direct Air Stream
Vent Vapor Stream
CEX1
Cold Storage 1
100
200
300
400
500
600

ENERGY STORAGE AND RECOVERY METHODS, SYSTEMS, AND DEVICES

CROSS-REFERENCE TO RELATED APPLICATIONS

The present application claims the benefit of U.S. Provisional Application No. 61/913,773, filed Dec. 9, 2013, which is hereby incorporated by reference herein in its entirety.

FIELD AND BACKGROUND

Embodiments relate generally to the field of energy storage and recovery, and more specifically to obtaining a significant increase in round-trip efficiency and/or operating profit through use of liquid air energy storage (LAES) systems and methods with rational combination of the processes for liquid air and/or thermal energy production, storage and/or recovery. Some embodiments further relate to LAES systems, including improved LAES systems and methods intended for operation preferably in environmentally-friendly and/or stand-alone regimes.

A planned and started transfer to the decarbonized power grids can be based on increased use of renewable (mainly wind and solar) energy sources, a share of which in global electricity generation should be increased up to 11-12% by 2050 in the BLUE Map scenario. See, "Prospects for Large-Scale Energy Storage in Decarbonized Power Grids", Working Paper, IEA 2009 (hereinafter "IEA 2009 Working Paper"). However, with large shares of these technologies, it may be desirable to take steps to ensure the on-demand and reliable supply of electricity, taking into account a variable output of the renewable energy sources and a frequent both positive and negative unbalance between this output and a current demand for power.

SUMMARY

In one or more embodiments, a method of energy storage and recovery can include in combination a process of charging the energy storage with liquid air and thermal energy in the form of heat through consumption of power from the grid or any other source and a process of discharging the energy storage through conversion of the stored air and heat into power delivered into the grid or to any other consumer, accompanied by accumulation of cold extracted from discharged air and thereafter used in the process of energy storage charging. The process of energy storage charging can include in combination: sequential compressing a charging air in the plurality of intercooled air compressors up to a charging pressure exceeding the air critical point; storing the compression heat extracted from the pressurized charging air in the processes of its intercooling and aftercooling for the following recovery during the energy storage discharging; deep cooling a charging air stream and its liquefaction, resulting from exchange of thermal energy with cold storage medium and a vent air stream; expanding the liquefied charging air stream with succeeding separating the resulting liquid and gaseous phases of expanded stream; recovering a cold of gaseous phase (vent stream) and storing a liquid phase of the charging air at a practically atmospheric pressure in liquid air tank. The process of energy storage discharging can include in combination: pumping a discharged liquid air stream up to pressure exceeding a pressure of charging air at the last compressor outlet; preheating and regasification of a discharged air stream, resulting from exchange of thermal energy with cold storage medium; further preheating and superheating a discharged air stream using the stored compression heat; and expanding a superheated discharged air stream in the plurality of air expanders with reheating the expanded air stream using a stored compression heat. The improvement in the method can include in combination: compressing the inlet air in the plurality of the air compressors up to charging pressure exceeding its critical point at the last compressor outlet by 2-4 bar at most; pumping the liquid air up to discharging pressure exceeding charging air pressure; deep cooling the charging air stream down to a temperature at the deep cooling system outlet, selected in the range from −170° C. to −180° C. and allowing to reach a target air liquefaction ratio in the range from 75 to 85% at a practically atmospheric pressure in the liquid air tank; conducting a process of deep cooling the charging air stream in three sequential stages, wherein the air temperature is progressively reduced from a temperature at the deep cooling system inlet down to a selected outlet temperature and wherein a temperature drop at the second stage reduces charging air temperature by 1.5-38.5° C., beginning from a temperature at which air heat capacity achieves its maximum value in a process of air deep cooling; controlled dividing the charging air stream at the inlet of the first stage into two parallel streams, providing in-parallel passing the first stream through the first cold exchanger in the direction opposite to a vent vapor stream and the second stream through the first cold storage, resulting in the same outlet temperature of both streams combined at the outlet of the first stage, and simultaneously providing the optimal mass-flow relationship between the first and second streams as (9%-17%):(91%-83%); controlled dividing the charging air stream at the inlet of the second stage into three parallel streams, providing in-parallel passing the first stream through the second cold exchanger in the direction opposite to a vent vapor stream, the second stream through the second cold storage and the third stream through a balance cold exchanger being serviced by an external cold source, resulting in the same outlet temperature of all streams combined at the outlet of the second stage, and simultaneously providing the optimal mass-flow relationship between the first, second and third streams as (3%-8%):(20%-51%):(46%-76%); and controlled dividing the charging air stream at the inlet of the third stage into two parallel streams, providing in-parallel passing the first stream through the third cold exchanger in the direction opposite to a vent vapor stream, and the second stream through the third cold storage, resulting in the same outlet temperature of both streams combined at the outlet of the third stage, and simultaneously providing the optimal mass-flow relationship between the first and second streams as (9%-57%):(91%-43%).

In one or more embodiments, a method of liquid air energy storage and recovery can include charging a liquid air energy storage (LAES) with power from a power source, the charging including storing thermal energy. The method can include discharging the LAES including generating electrical power by converting liquid air resulting from the charging and thermal energy resulting from the storing thermal energy, the discharging resulting in the withdrawal of thermal energy from a cold storage by discharged air. The charging can include: sequentially compressing charging air in a plurality of intercooled air compressors up to a charging pressure exceeding the air critical point; storing, for recovery during the energy storage discharging, the compression heat extracted from pressurized charging air resulting from its intercooling and aftercooling in a compression heat storage; deep cooling a charging air stream and its liquefaction, resulting from exchange of thermal energy with cold storage medium and a vent air stream; expanding the liquefied charging air stream with succeeding separating the resulting liquid and gaseous phases of expanded stream; and cooling the charging air, using a vent stream, and storing a resulting liquid phase of the charging air at near atmospheric pressure in liquid air tank. The method can include discharging the LAES, which can include: pumping a discharged liquid air stream up to pressure exceeding a pressure of charging air at a final charging compressor outlet during charging; preheating and vaporizing a liquid discharge air stream at least partially using thermal energy from the cold storage medium; further preheating and superheating a discharged air stream using the stored compression heat from the compression heat storage; and expanding a resulting superheated discharge air stream, in a plurality of air expanders including reheating the expanded air stream using a stored compression heat. The charging can include compressing the inlet air in the plurality of the air compressors up to charging pressure exceeding its critical point at the last compressor outlet by 2-4 bar at most. The discharging can include pumping the liquid air up to discharging pressure exceeding a charging air pressure. The charging can include deep cooling the charging air stream down to a temperature at the deep cooling system outlet, selected in the range from −170° C. to −180° C. and allowing the resulting charging air stream to reach a target air liquefaction ratio in the range from 75 to 85% at a practically atmospheric pressure in the liquid air tank. The charging can include conducting a process of deep cooling the charging air stream in first, second and third sequential stages, wherein the air temperature is progressively reduced from a temperature at the deep cooling system inlet down to a selected outlet temperature and wherein a temperature drop at the second stage reduces charging air temperature by 1.5-38.5° C., beginning from a temperature at which air heat capacity achieves its maximum value in a process of air deep cooling. The charging can include dividing the charging air stream at the inlet of the first stage into two parallel streams and passing the first stream through the first cold exchanger in the direction opposite to a vent vapor stream and passing the second stream through a first portion of the cold storage, resulting in a same outlet temperature of both streams which are combined including simultaneously providing a mass-flow relationship between the first and second streams of (9%-17%):(91%-83%). The charging can include dividing the charging air stream at the inlet of the second stage into three parallel streams, providing in-parallel passing the first stream through the second cold exchanger in the direction opposite to a vent vapor stream, the second stream through the second cold storage and the third stream through a balance cold exchanger being serviced by an external cold source, resulting in the same outlet temperature of all streams combined at the outlet of the second stage, and simultaneously providing the optimal mass-flow relationship between the first, second and third streams of (3%-8%):(20%-51%):(46%-76%). The charging can include dividing the charging air stream at the inlet of the third stage into two parallel streams, in-parallel passing the first stream through the third cold exchanger in the direction opposite to a vent vapor stream, and the second stream through the third cold storage, resulting in the same outlet temperature of both streams combined at the outlet of the third stage, and simultaneously providing mass-flow relationship between the first and second streams of (9%-57%):(91%-43%).

BRIEF DESCRIPTION OF THE DRAWINGS

Embodiments will hereinafter be described with reference to the accompanying drawings, which have not necessarily been drawn to scale. Where applicable, some features may not be illustrated to assist in the illustration and description of underlying features. Throughout the figures, like reference numerals denote like elements. As used herein, various embodiments can mean one, some, or all embodiments.

DETAILED DESCRIPTION

Figure 1:
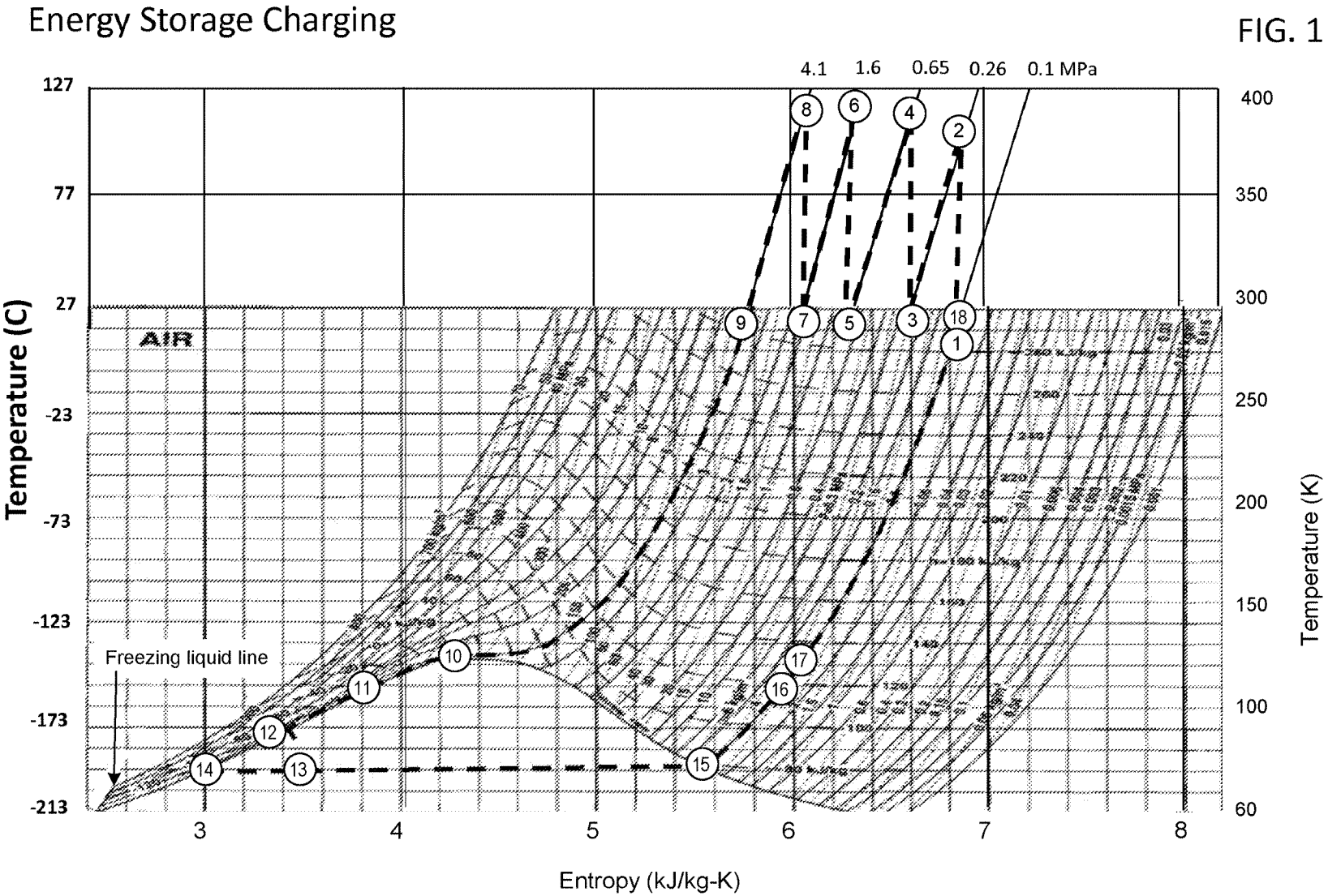
FIG. 1 shows the T-S diagram for charging the liquid air energy storage, in accordance with an embodiment.

One of the possible ways for solving potential problems with renewable (e.g., wind and solar) energy sources, such as the problems discussed hereinabove, is the use of large-scale energy storages in the decarbonized power grids. According to the IEA estimates in the IEA 2009 Working Paper, an installed capacity of such energy storages should be increased from 100 GW in 2009 up to 189-305 GW by 2050. The large-scale energy storages could also solve a problem of operating the base-load (mainly coal and nuclear) power plants without significant reduction in their output during off-peak (low demand for power) hours in electrical grids.

Amongst the known energy storage technologies able to accumulate a lot of energy and store it over a long time-period, a recently proposed Liquid Air Energy Storage (LAES) technology is distinguished by the freedom from any geographical, land and environmental constraints inherent in other large-scale energy storage technologies: Pumped Hydroelectrical Storage and Compressed Air Energy Storage. In addition, LAES technology is characterized by much simpler permitting process and a possibility for co-location with any available sources of natural or artificial, cold or/and hot thermal energy, which may be used for enhancement of its power output. See, "Liquid Air in the Energy and Transport Systems", Centre for Low Carbon Futures, May 2013. Therefore the LAES technology is selected as a matter for improvement in some embodiments.

Some LAES improvements studied by the inventors are related to LAES systems with the cold thermal energy storage. The cold storages provide some or all of the cold thermal energy required for charging air liquefaction through extraction of this energy from discharged air stream and/or storing between the LAES discharging and charging. In particular, such a system is proposed in U.S. Patent Publication No. 2012/0216520, in which the LAES operation in the wide range of the possible pressures of charging ($P_{CH}$) and discharged ($P_{DCH}$) air streams from 38 to 340 barA and at any their relationship is described. However, investigations conducted with regard to the air thermodynamic properties at the cryogenic temperatures and supercritical pressures have confirmed a possibility of such operation only when a pressure $P_{CH}$ somewhat exceeds a pressure $P_{DCH}$, resulting in a significant reduction of the LAES round-trip efficiency. In all other cases a cold capacity of the cold thermal energy storage should be supplemented with the cold from any available and appropriate external source.

The use of such external cold source in the form of liquefied fuel is described in U.S. Patent Publication No. 2003/0101728, in which the LAES operated at the pressure relationship $P_{DCH}>P_{CH}$ is used to supply a gas turbine during on-peak hours with a pressurized combustion air produced in the liquid form during off-peak hours. However, this approach to use of a liquefied fuel cold energy is applied only to the multi-engine power plant, wherein production of liquid air for one gas turbine taken out of service is accompanied by the ongoing work of other liquid fuel-fired gas turbines. In addition, a cold of liquefied fuel is here used for only subcooling the liquid charging air at the outlet of cold thermal energy storage, whereas the most of cold deficiency in the storage is compensated by another and much energy-intensive way.

Therefore, there may be a desire to elaborate a method for energy storage and recovery based on the LAES technology operated at the pressure relationship $P_{DCH}>P_{CH}$ and possessing a reasonable round-trip efficiency. In some embodiments, a method for common use of an external cold source and the cold thermal energy storage in such a LAES can minimize the operation profit losses caused by the purchase of cold energy from an external source. Some embodiments provide a novel approach to the common use of the external cold source and the cold thermal energy storage in such a LAES configuration. Such embodiments can simplify the technological scheme of the LAES operated at the pressure relationship $P_{DCH}>P_{CH}$, resulting in a marked decrease in the LAES capital costs. In addition, demand for supplemental cold energy provided by an external source can be minimized, which in turn can result in a significantly reducing the power consumed by the cold source and can also result in a corresponding minimization of the losses in LAES operation profit.

In some embodiments, a proposed method of energy storage and recovery based on use of Liquid Air Energy Storage (LAES) technology may comprise in combination a process of charging the energy storage with liquid air and thermal energy in the form of heat through consumption of power from the grid or any other source and a process of discharging the energy storage through conversion of the stored air and heat into power delivered into the grid or to any other consumer, accompanied by accumulation of cold extracted from discharged air and thereafter used in the process of energy storage charging.

In some embodiments, in the proposed method the charging process may further comprise in combination: sequential compressing a charging air in the plurality of intercooled air compressors up to a charging pressure exceeding the air critical point; storing the compression heat extracted from the pressurized charging air in the processes of its intercooling and aftercooling for the following recovery during the energy storage discharging; deep cooling a charging air stream and its liquefaction, resulting from exchange of thermal energy with cold storage medium and a vent air stream; expanding the liquefied charging air stream with succeeding separating the resulting liquid and gaseous phases of expanded stream; recovering a cold of gaseous phase (vent stream) and storing a liquid phase of the charging air at a practically atmospheric pressure in liquid air tank.

In some embodiments, in the proposed method the discharging process may further comprise in combination: pumping a discharged liquid air stream up to pressure exceeding a pressure of charging air at the last compressor outlet; preheating and regasification of a discharged air stream, resulting from exchange of thermal energy with cold storage medium; further preheating and superheating a discharged air stream using the stored compression heat; and expanding a superheated discharged air stream in the plurality of air expanders with reheating the expanded air stream using a stored compression heat.

In some embodiments, the improvements in the proposed method may further comprise in combination: compressing a charging air up to pressure at the last compressor outlet exceeding its critical value by 2-4 bar at most; pumping a discharged air up to pressure at the pump outlet exceeding a charging air pressure; deep cooling the charging air stream down to a selected temperature at the deep cooling system outlet, lying in the range from −170° C. to −180° C. and allowing to reach a target air liquefaction ratio in the range from 75 to 85%; conducting a process of deep cooling the charging air stream in three sequential stages, wherein a temperature drop at the second stage reduces air temperature by 1.5-38.5° C., beginning from a temperature at which air heat capacity achieves its maximum value in a process of air deep cooling; controlled dividing the charging air stream at the inlet of the first and third stages of deep cooling process into two parallel streams passing correspondingly through the first and third vent stream cold exchangers and through the first and third cold storages and combined at the outlet of said stages; and controlled dividing the charging air stream at the inlet of the second stage of deep cooling process into three parallel streams passing correspondingly through the second vent stream cold exchanger, second cold storage and a balance cold exchanger being serviced by an external cold source and combined at the outlet of said stages.

In some embodiments, the improvements in the proposed method may further provide a cold capacity of the external source in the range from 45 to 80% of a cold capacity requirements at the second stage of deep cooling process and from 3 to 18% of a cold capacity required in the deep cooling process as a whole.

In some embodiments, the improvements in the proposed method may further comprise a proper selection of the appropriate external cold source and cold carrier, use of the different cold storage media, and recovery of a cold thermal energy of the exhausted discharged air stream.

In accordance with an embodiment, a method of energy storage and recovery based on use LAES technology comprises the combination of two general processes: a general process of charging the energy storage with liquid air and thermal energy through consumption of power from the grid or any other source, and a general process of discharging the energy storage through conversion of the stored liquid air and thermal energy into power delivered into the grid or to any other consumer, accompanied by accumulation of cold extracted from discharged air and thereafter used in the process of energy storage charging.

FIG. 1 shows the T-S diagram for charging the liquid air energy storage, in accordance with an embodiment. The general process of charging the energy storage with liquid air and thermal energy through consumption of power from the grid or any other source may be exemplified by the FIG. 1 as a combination of the following processes at the T-S diagram of air:

Process 1-2-3-4-5-6-7-8-9—capturing the inlet air at 1 bar and 15° C. and its sequential compressing in the 4 air compressors up to a selected charging pressure of 40 bar exceeding the air critical point by 2.1 bar, accompanied by: a) a corresponding increase in charging air temperature at the outlet of each compressor up to 110-117° C.; b) intercooling the pressurized charging air between the compressors, resulting in a decrease in its temperature at the inlet of each compressor down to a value of about 20° C.; c) reducing the air moisture and removing a resultant condensate between the compressors; d) aftercooling the pressurized charging air at the outlet of last compressor, resulting in a decrease in its temperature down to a value of 20° C.; e) further reducing the air moisture and removing a resultant condensate at the outlet of last compressor; f) storing of heat extracted from the pressurized charging air in the processes of its intercooling and aftercooling for the following recovery during the energy storage discharging; and g) removing the carbon dioxide and remainder of air moisture from the pressurized charging air, resulting in formation of the pressurized and treated charging air stream at the deep cooling system inlet. A power required for driving the compressors is consumed during the energy storage charging from the grid or any other external sources. It should be realized that for simplicity sake the process is described as a sequence of the isentropic compression of air in each compressor, isobaric intercooling of air at the outlet of each compressor and its isobaric aftercooling at the outlet of last compressor. The actual data of the process may be obtained with regard to the isentropic efficiency of the compressors and air pressure drop in the cooling equipment.

Process 9-12—passing the charging air stream through a deep cooling system, resulting in reducing its temperature at the system outlet down to a selected temperature of −175° C. and in full air liquefaction at a selected temperature and a pressure, which is less than a selected charging pressure of 40 bar by a value of pressure drop in the processes of air aftercooling, filtering and deep cooling. A reduction in temperature of the charging air stream results mainly from exchange of thermal energy with a cold storage medium and a vent vapor stream, which is a by-product of the air liquefaction. However, a combined cold capacity of these two internal cold sources is inadequate to reach a selected temperature of the charging air stream. Therefore, a deficient cold capacity shall be added to the process of air deep cooling from an external cold source in the most economic way.

For this purpose the process of deep cooling the charging air stream is proposed to conduct in three sequential stages, wherein the charging air temperature is progressively reduced: at the first stage from point 9 to point 10, namely, down to a temperature $T_{Cp-max}$=−140° C. which is close to a value at which charging air heat capacity achieves its maximum value in a process of air deep cooling at the charging pressure; at the second stage from point 10 to point 11, namely, down to a temperature of −154° C., which is less than $T_{Cp=max}$ value by 14° C.; and at the third stage from point 11 to point 12, namely, down to a selected temperature of −175° C., which further provides achieving a target air liquefaction ratio. A charging air temperature drop between the points 10 and 11 is proposed to determine in accordance with the target air liquefaction ratio and selected pressure of the discharged air stream. Other factors being equal, a temperature interval for the second stage is increased with increase in the target air liquefaction ratio and discharged air pressure. Conducting the deep cooling process by stages and a mechanism for determination of the temperature boundaries for each stage is further described with use of the FIGS. 3 and 4.

The first stage of charging air deep cooling is conducted using controlled dividing the charging air stream at the inlet of this stage (point 9) into two parallel streams, providing in-parallel passing the first stream through the first cold exchanger in the direction opposite to a vent vapor stream and the second stream through the first cold storage. This results in the same outlet temperature of both streams combined at the outlet of the first stage.

The second stage of charging air deep cooling is conducted using controlled dividing the charging air stream at the inlet of this stage (point 10) into three parallel streams, providing in-parallel passing the first stream through the second cold exchanger in the direction opposite to a vent vapor stream, the second stream through the second cold storage and the third stream through a balance cold exchanger being serviced by an external cold source. This results in the same outlet temperature of all streams combined at the outlet of the second stage.

The third stage of charging air deep cooling is conducted using controlled dividing the charging air stream at the inlet of this stage (point 11) into two parallel streams, providing in-parallel passing the first stream through the third cold exchanger in the direction opposite to a vent vapor stream, and the second stream through the third cold storage. This results in the same outlet temperature of both streams combined at the outlet of the third stage.

At the first stage of deep cooling process the dividing of the charging air stream provides the mass flow relationship between the first and second streams as 13%:87%, which seems to be optimal at the selected charging and discharged air pressures and selected temperature at the deep cooling system outlet.

At the second stage of deep cooling process the dividing of the charging air stream provides the mass flow relationship between the first, second and third streams as 4%:30%:66%, which seems to be optimal at the selected charging and discharged air pressures and selected temperature at the deep cooling system outlet.

At the third stage of deep cooling process the dividing of the charging air stream provides the mass flow relationship between the first and second streams as 16%:84%, which seems to be optimal at the selected charging and discharged air pressures and selected temperature at the deep cooling system outlet.

In accordance with some embodiments, at the first and third stages deep cooling the charging air stream is conducted using mainly or exclusively the cold capacities, provided by the vent vapor stream and cold storage medium, whereas at the second stage the internal cold capacities are supplemented by a cold capacity of the external cold source, providing 66% of a cold capacity required at this process stage and 13% of a cold capacity required in the deep cooling process as a whole. It should be stressed that all figures of desired and available cold capacities are herein estimated without consideration of the thermal losses in the cold storages.

At the second stage of deep cooling process a balance cold exchanger may be serviced with an appropriate cold carrier generated by the external cold source in the form, for example, of the balance cold generator with use of the well-known mixed refrigerant or turbo-expander technologies and consumption of a power from the grid or any other source for this purpose during energy storage charging.

An appropriate cold carrier, such as, for example, a liquefied natural gas, can be circulated in a closed loop between a balance cold generator and a balance cold exchanger and can provide phase-change heat transfer in this cold exchanger.

An external cold source in the form of any source of liquefied natural gas may be alternatively used. The liquefied natural gas can be delivered into a balance cold exchanger in liquid form, captured from the balance cold exchanger, and delivered to any consumers in the gaseous form.

Liquid propane may also be used as a cold storage medium to provide a convective indirect exchange of thermal energy with the charging air stream during energy storage charging and with the discharged air stream during energy storage discharging in the corresponding cold exchangers integrated with the cold storages.

As another example, a pebble may be used as an alternative cold storage medium to provide a direct exchange of thermal energy with the charging air stream during energy storage charging and with the discharged air stream during energy storage discharging.

Process 12-13—isenthalpic expanding the charging air stream down to a practically atmospheric pressure, resulting in vaporizing a lesser (20%) part of the charging air stream. Processes 13-14 and 13-15—separating the liquid and vapor air phases of the charging air stream, resulting in producing the liquid air from the most (80%) part of this stream and achieving a target (80%) air liquefaction ratio at a practically atmospheric pressure.

Process 15-16-17-1—process of venting the separated air vapor through a deep cooling system in the opposite direction at a practically atmospheric pressure, wherein the vent vapor stream exchanges thermal energy with the charging air stream, thus providing at least a portion of cold capacity of a system, which may be desired for deep cooling the charging air stream. In some embodiments, the process is divided into three stages 15-16, 16-17 and 17-1, as described above, and conducted in three cold exchangers. A full stream of vent air passes sequentially through these cold exchangers, whereas a mass flow of the charging air stream directed into each of the cold exchangers is changed in accordance with the given and selected process data. In some embodiments, the temperatures of the vent air stream at the outlet of each stage, which provide an exchange of thermal energy, are equal to −155° C., −141° C. and 19° C. correspondingly.

Point 14—storing the separated liquid air in the storage tank during the time-period between the charging and discharging the energy storage at the temperature of −194° C. and a practically atmospheric pressure.

Figure 2:
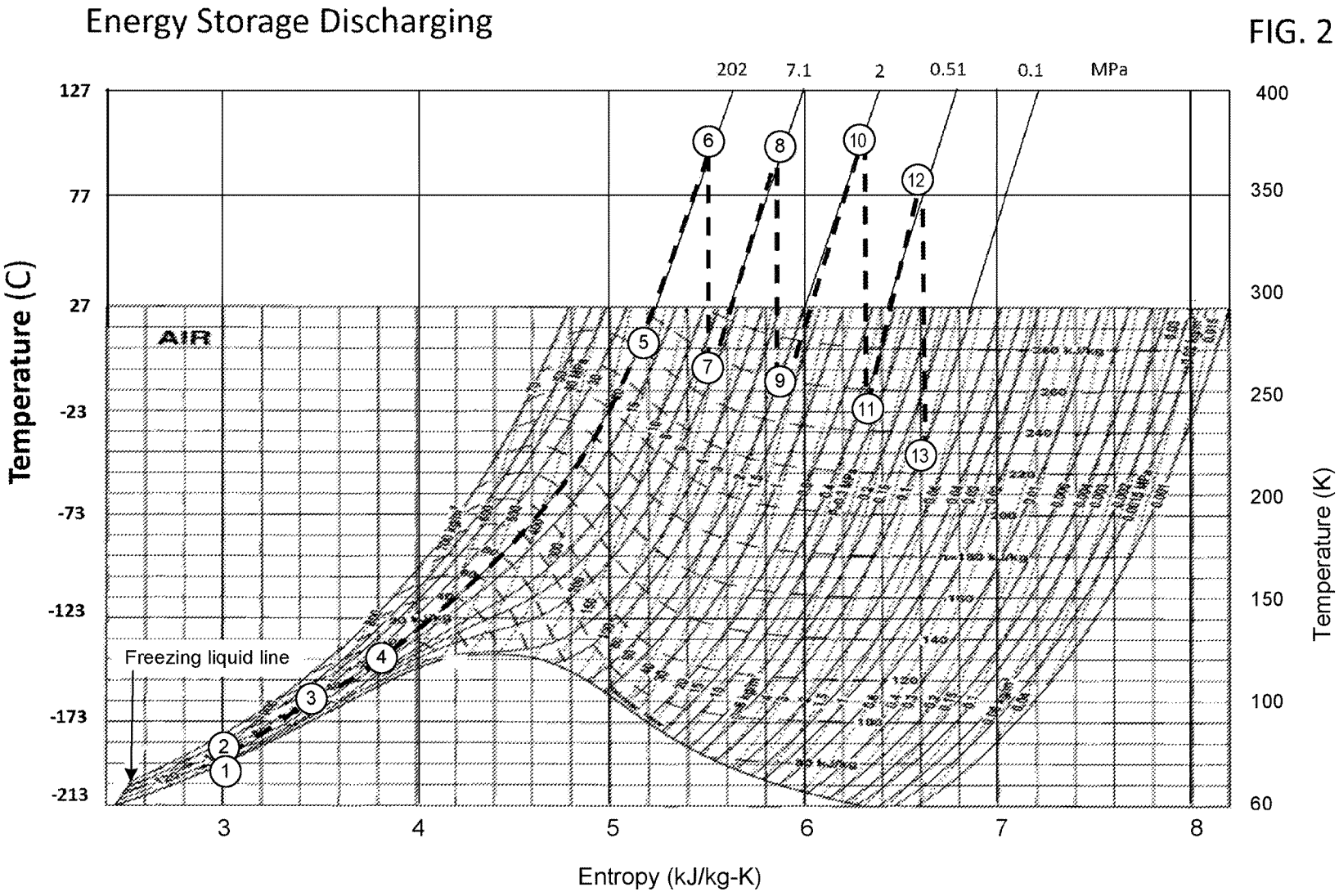
FIG. 2 shows the T-S diagram for discharging the liquid air energy storage, in accordance with an embodiment.

FIG. 2 shows the T-S diagram for discharging the liquid air energy storage, in accordance with an embodiment. The general process of discharging the energy storage through conversion of the stored air and heat into power delivered into the grid or to any other consumer, accompanied by accumulation of cold extracted from the discharged air and thereafter used in the process of energy storage charging, may be exemplified by FIG. 2 as a combination of the following processes at the T-S diagram of air:

Process 1-2—capturing the liquid air from the storage tank and pumping it up to a discharged air pressure of 200 bar exceeding a pressure of charging air at the outlet of the last compressor, resulting in formation of the discharged air stream at the inlet of a deep cooling system in the direction opposite to one of the charging air stream during energy storage charging.

Process 2-5—passing the discharged air stream through a deep cooling system, resulting in exchange of thermal energy with cold storage medium, accompanied by the progressive increase in temperature of air and its full vaporization, thus storing the cold extracted from the discharged air stream and providing the most part of cold capacity, which may be desired for deep cooling the charging air stream during the energy storage charging. In some embodiments, the process in divided into three stages 2-3, 3-4 and 4-5 and conducted in three cold storages. A full or partial stream of discharged air passes sequentially through these cold storages, thereby the temperatures of the discharged air at the outlet of each stage are correspondingly equal to −159° C., −145° C. and 15° C. correspondingly.

Process 5-6—further superheating the discharged air stream up to approximately 100° C., using the heat extracted from the charging air stream during its aftercooling and stored between the energy storage charging and discharging.

Process 6-7-8-9-10-11-12-13—directing the superheated discharged air stream into the first of 4 air expanders at a pressure which is less than 200 bar by a value of pressure drop in the deep cooling system and aftercooler with following passing the discharged air stream through other air expanders, accompanied by: a) a sequential decrease in air pressure and temperature at the outlet of each expander; b) reheating the discharged air stream between the expanders by the heat extracted from the charging air stream during its intercooling, resulting in an increase in temperature of the discharged air stream at the inlet of each expander up to approximately 100-115° C.; c) finally reducing the air pressure and temperature at the outlet of last expander (point 13) down to atmospheric value and −40° C.; and d) delivering the power produced by the expanders to the grid or any other consumers. It should be realized that for simplicity sake the process is described as a sequence of the isentropic expansion of air in each expander and isobaric preheating and reheating of air at the inlet of each expander. The actual data of the process may be obtained with regard to an actual isentropic efficiency of the expanders and actual air pressure drop in the heating equipment. An actual isentropic efficiency of the air expanders is typically below 100%, resulting in a some increase in its outlet temperature above a value indicated in the point 13. With regard to this fact and taking into account the selected value of discharged air pressure, two different methods of conducting the process of air expansion and reheating are suggested.

According to the first of these methods, passing the discharged air stream through a plurality of air expanders and its reheating between the expanders is organized in such a way as to provide a temperature of discharged air at the last expander outlet close to ambient air temperature.

According to the second of these methods, passing the discharged air stream through a plurality of air expanders and its reheating between the expanders is organized in such a way as to keep a temperature of air at the last expander outlet markedly below ambient air temperature (as it is indicated in the FIG. 2). It makes possible to extract a cold thermal energy of the discharged air stream escaping the last air expander through its heating up to exhaust temperature slightly below ambient air temperature. In turn, an extracted cold thermal energy may be stored and recovered in the process of the energy storage charging, using two alternative methods of recovering the extracted cold thermal energy recovery, which are not shown in the FIGS. 1 and 2 and will be explained below as applied to FIG. 7 and FIG. 8.

The first alternative method includes subjecting the charging air stream to precooling at the deep cooling system inlet during the energy storage charging, using cold thermal energy extracted from the discharged air stream at the outlet of the last expander during energy storage discharging and stored between the storage discharging and charging processes.

The second alternative method includes subjecting the charging air captured from atmosphere during the energy storage charging to precooling at the inlet of the first air compressor, using cold thermal energy extracted from the discharged air stream at the outlet of the last expander during energy storage discharging and stored between the storage discharging and charging processes.

Finally, the last embodiment of the proposed method (not shown in FIG. 1 or FIG. 2) may include recovering any waste heat from the external energy sources for preheating the discharged air stream at the inlet of the first expander and for reheating the discharged air stream at the inlet of other expanders during energy storage discharging.

Both the general processes of energy storage charging and discharging shall be considered taking into account the drastic difference in the thermodynamic properties of the air streams involved in these processes.

Figure 3:
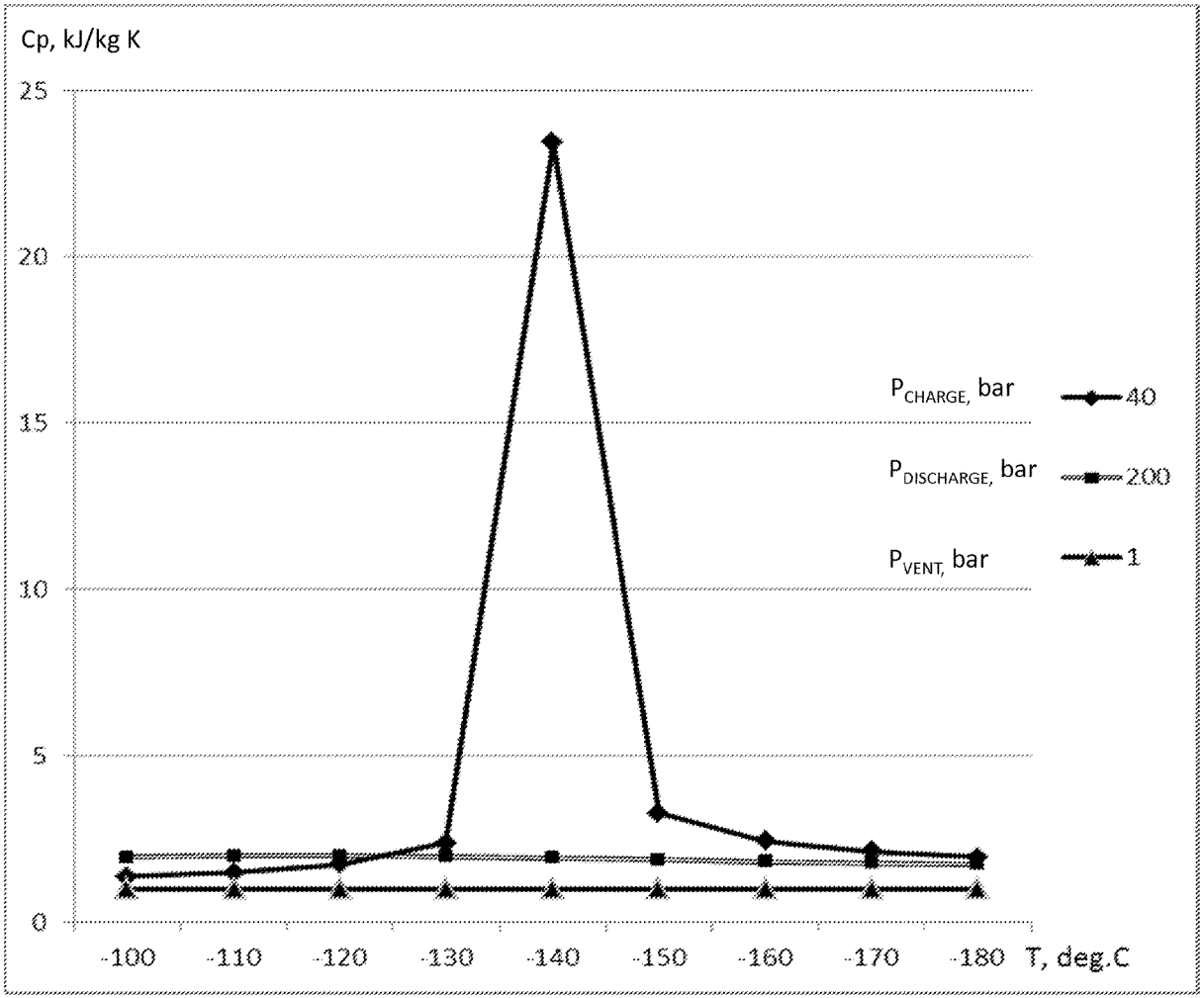
FIG. 3 shows a specific heat capacity of air vs. its pressure at cryogenic temperatures, in accordance with an embodiment.

FIG. 3 shows a specific heat capacity of air vs. its pressure at cryogenic temperatures, in accordance with an embodiment. As shown in the FIG. 3, a specific heat capacity of the charging air stream being deeply cooled from −125° C. to −155° C. in the process of its liquefaction, for example at 40 bar, drastically exceeds the specific heat capacities of the air streams being used for deep cooling purposes: a discharged liquid air stream at the pressure of 200 bar and a vent air vapor stream at the pressure of 1 bar. This dramatically hampers a heat transfer in the processes of air cooling, liquefaction, heating and vaporization being conducted with use of the cold exchangers and storages and results in a deficit of cooling capacity of these two internal cold sources. One of the goals of embodiments is the elimination of this drawback of the liquid air energy storage systems.

Figure 4:
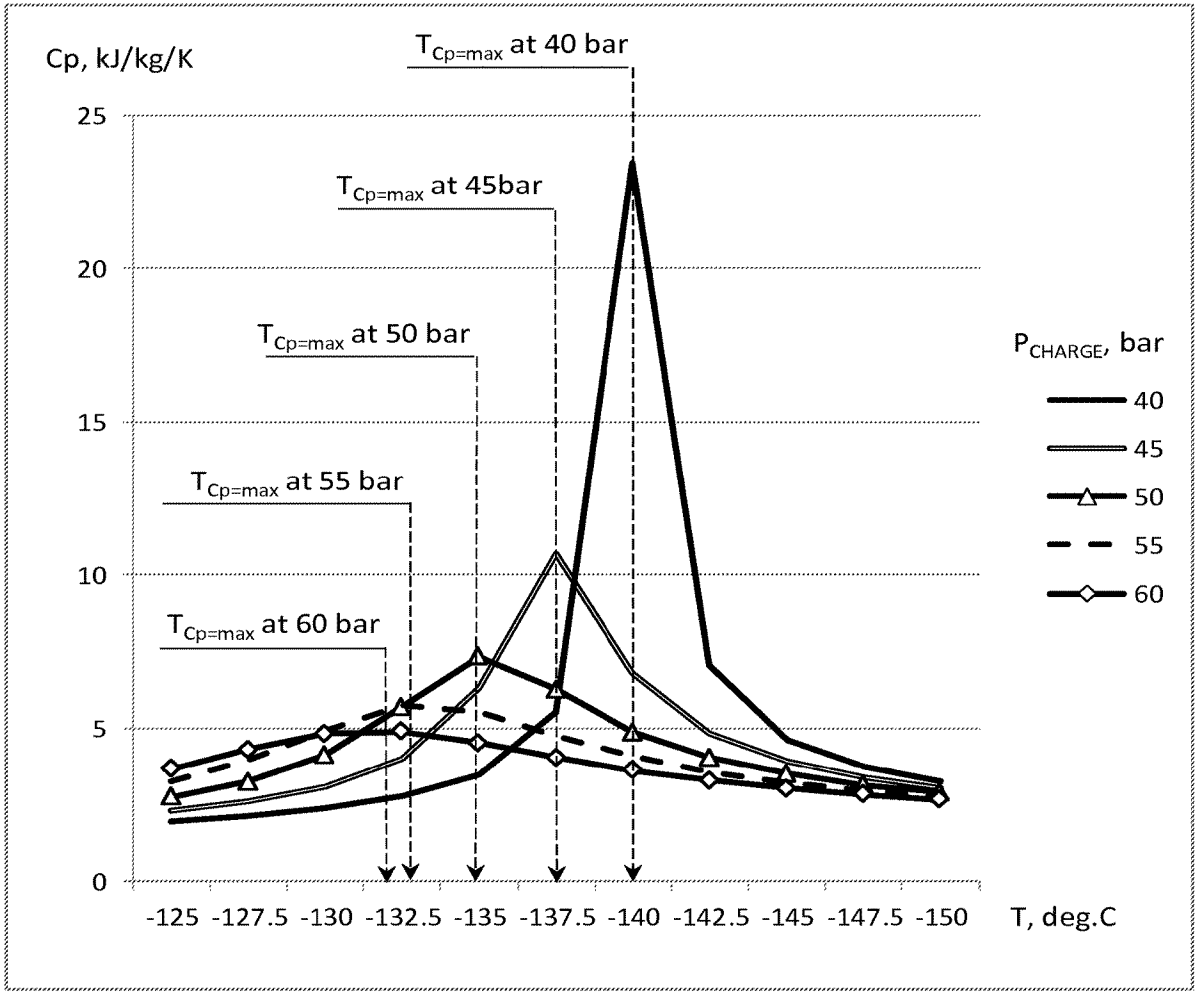
FIG. 4 shows the approach used for determination of air temperatures at which maximum value of specific heat capacity is achieved, in accordance with an embodiment.

FIG. 4 shows the approach used for determination of air temperatures at which maximum value of specific heat capacity is achieved, in accordance with an embodiment. As shown in the FIG. 4, the mentioned deficit in cold storage capacity could be reduced through an increase in a pressure of the charging air stream from, for example, 40 bar up to 60 bar. It can result in a corresponding drastic decrease in air specific heat capacity in the mid of deep cooling process and in some its reduction in the latter part of this process. However, at the initial stage of deep cooling process the air specific heat capacity is in contrast markedly increased with an increase in air pressure. In addition, any increase in charging air pressure leads to a significant increase in power consumed by the compressors, whereas a corresponding increase in air liquefaction ratio at the selected air temperature before throttling device is negligibly small.

It may be exemplified by the data listed in Table 1 below, wherein an increase in pressure of charging pressure at the outlet of last compressor from 38 bar up to 60 bar makes it possible to decrease power consumed by the balance cold generator from 98.6 down to 86.6 kWe, that is by 12 kWe. At the same time, a power consumed by the last air compressor is increased by 62 kWe. By this means, an increase in charging air pressure can't be a method of reduction in power consumed in the energy storage discharging process. Conversely, this pressure shall exceed a critical pressure of air (37.86 bar) by a value of pressure drop in the processes of air aftercooling and deep cooling only. With regard to this fact, in some embodiments a pressure of charging air at the outlet of last compressor is selected as a value exceeding an air critical pressure by 2-4 at most.

TABLE 1

Comparative analysis of the power consumed by the high pressure compressors and balance cold generator for 1 kg/s of charging air flow.

| Cooled air pressure, bar | | Compressor | $T_{Cp-max}$ | $Q_{REQ1}$ | $Q_{REQ2}$ | Total $Q_{REQ}$ | | $Q_{REQ} - Q_{AVAIL}$ | |
|---|---|---|---|---|---|---|---|---|---|
| Initial | Final | power, kWe | ° C. | kCal/hr | kCal/hr | kCal/hr | kWth | kWth | kWe (COP = 0.5) |
| 1 | 2 | 3 | 4 | 5 | 6 | 7 | 8 | 9 | 10 |
| 15 | 38 | 102 | −141 | 205,705 | 113,301 | 319,006 | 370.9 | 49.3 | 98.6 |
| 15 | 40 | 109 | −140 | 210,720 | 107,805 | 318,525 | 370.4 | 48.8 | 97.5 |
| 15 | 45 | 124 | −137.5 | 210,140 | 107,189 | 317,329 | 369.0 | 47.4 | 94.7 |
| 15 | 50 | 138 | −135 | 207,135 | 109,009 | 316,144 | 367.6 | 46.0 | 92.0 |
| 15 | 55 | 152 | −132.5 | 203,653 | 111,319 | 314,972 | 366.2 | 44.6 | 89.3 |
| 15 | 60 | 164 | −130 | 200,001 | 113,811 | 313,812 | 364.9 | 43.3 | 86.6 |

| Cooling air streams | P | $Q_{AVAIL}$ | |
|---|---|---|---|
| | bar | kCal/hr | kWth |
| | 11 | 12 | 13 |
| Reverse | 200 | 239,946 | 279.0 |
| Vent vapor | 1 | 36,642 | 42.6 |
| Total $Q_{AVAIL}$ | | 276,588 | 321.6 |

Figure 5:
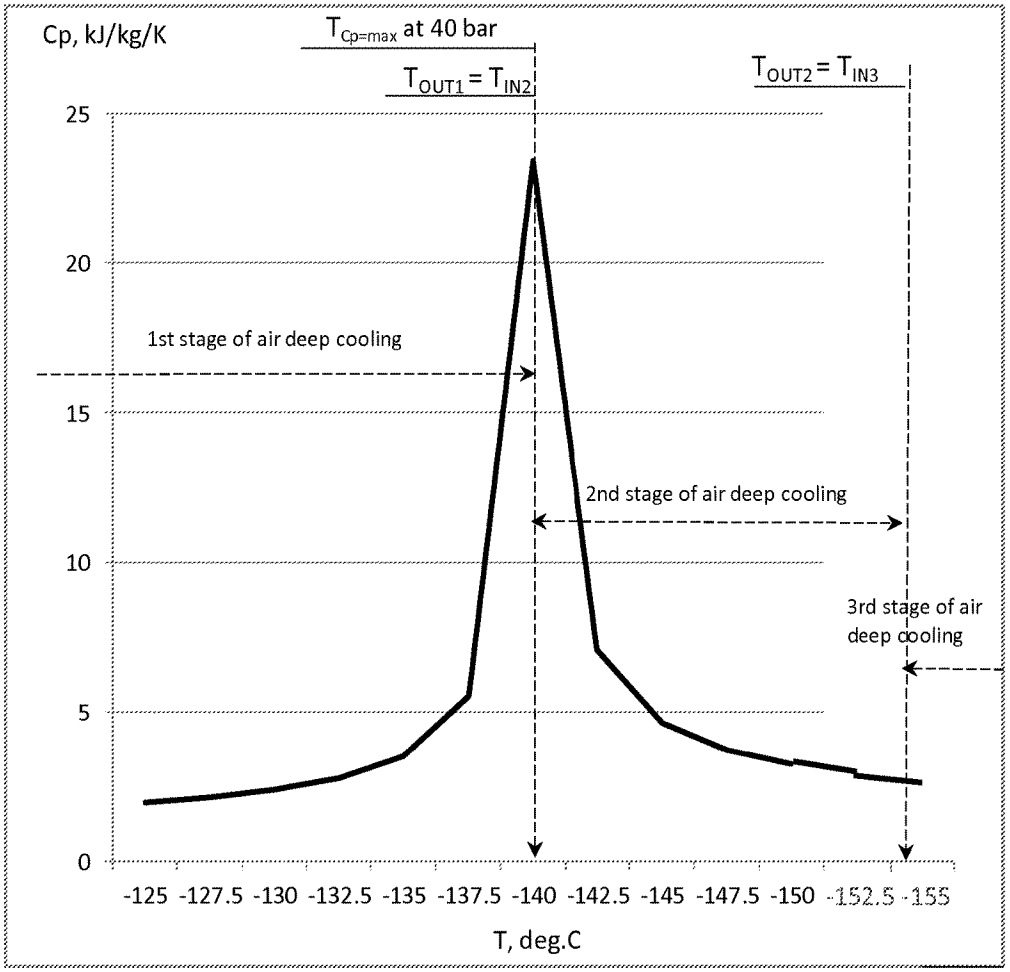
FIG. 5 shows the approach used for determination of temperature range for each stage of charging air deep cooling process, in accordance with an embodiment.

FIG. 5 shows the approach used for determination of temperature range for each stage of charging air deep cooling process, in accordance with an embodiment. FIG. 5 and the Table 2 are an example of determining the temperature boundaries for three stages of charging air deep cooling process conducted for the following selected data: charging air pressure—40 barA; discharged air pressure—200 barA; charging air temperature at the deep cooling process outlet—−175° C.; and air liquefaction ratio—80%. A temperature at which maximum air specific heat is achieved in the mentioned conditions is equal to −140° C.

TABLE 2

| Temperature boundaries of the deep cooling process | | | |
|---|---|---|---|
| Air Temperatures at the Process: | 1-st stage | 2-nd stage | 3-rd stage |
| Inlet | 20 | −140 | −154 |
| Outlet | −140 | −154 | −175 |

Figure 6:
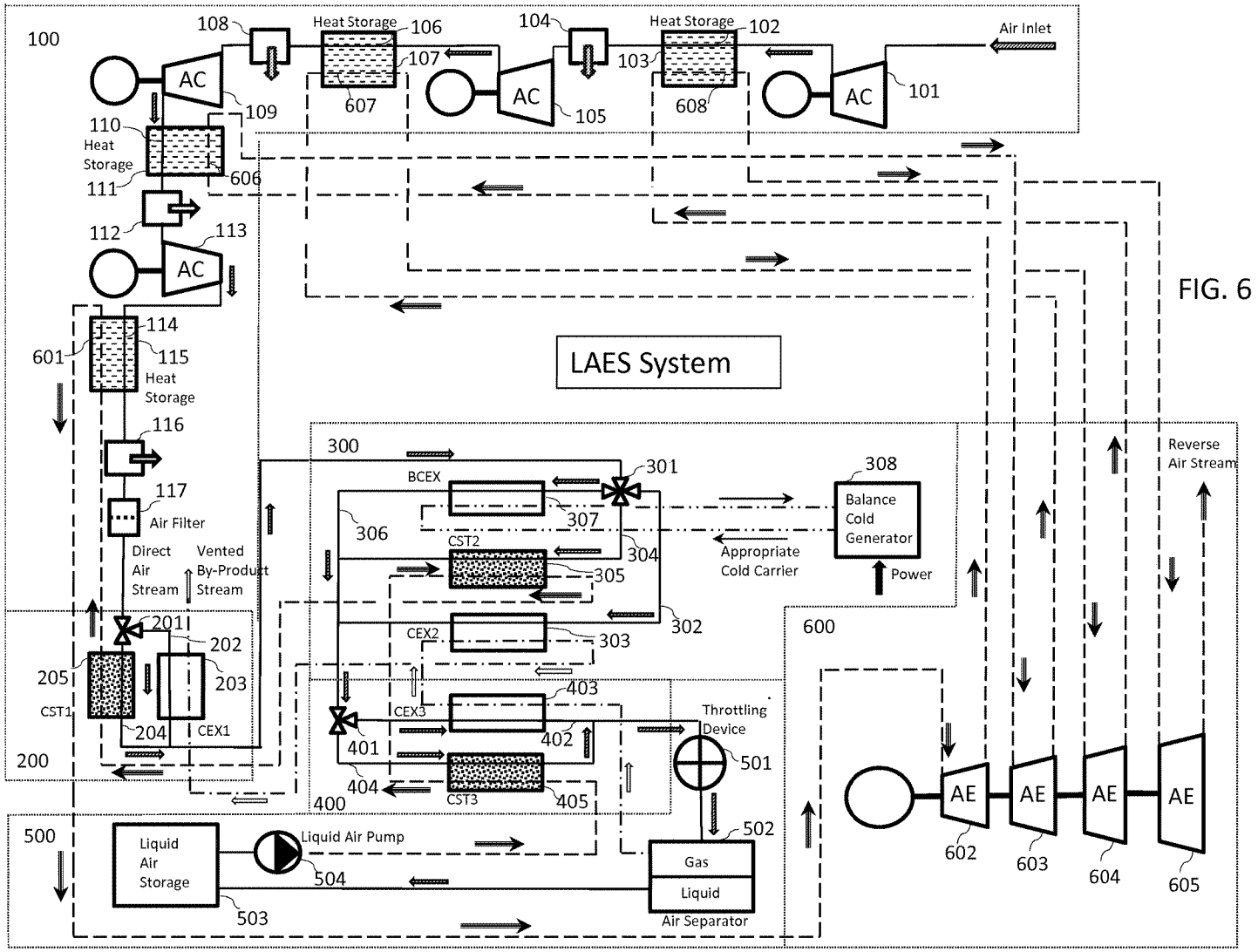
FIG. 6 shows a system realizing the proposed method of energy storage and recovery in accordance with a first embodiment.

The practical realization of the proposed method of energy storage and recovery based on the LAES technology may be performed with use of the system exemplified by FIG. 6. It consists of the six equipment packages, the segmentation of which has been done for the purpose of clarity:

100—the compression and cooling equipment;
200—the first stage of deep cooling system;
300—the second stage of deep cooling system;
400—the third stage of deep cooling system;
500—the separation and storage equipment; and
600—the expansion and reheating equipment.

FIG. 6 shows a system realizing the proposed method of energy storage and recovery in accordance with a first embodiment. As shown in the FIG. 6, the first equipment package 100 may integrate the air compression and cooling equipment, wherein an inlet air from the ambient environment is captured and passed through a plurality of the compressors, a set of the intercoolers and one aftercooler. Firstly, an inlet air is captured and compressed by the first compressor 101. At the outlet of this compressor the air is cooled down by passing through the first intercooler 102 integrated with a heat storage 103 wherein a compression heat is extracted from the pressurized air and accumulated in the storage 103 for the following recovery during the energy storage discharging. The water condensed from the pressurized air in the process of its cooling is removed using the first condensate extractor 104. Thereby, a temperature of compressed air at the outlet of extractor 104 is kept at the level slightly above ambient air temperature and preferably close to 20° C. The described process of air processing in the devices 101, 102, 103 and 104 is repeated at the next stages of air compression in the compressors 105, 109 and 113, its cooling in the intercoolers 106, 110 and aftercooler 114 integrated with the heat storages 107, 111 and 115 and its drying in the condensate extractors 108, 112 and 116.

The compressed air leaving the last condensate extractor 116 may be further involved into process of its additional treatment in the air filter 117, intended for removal of $CO_2$ and remainder of water from the air before its deep cooling. By this means at the outlet of filter 117 a charging stream of dried, preliminary cooled and pressurized air is formed. A charging air pressure at the outlet of the last compressor and a number of the described compression stages are selected with regard to three factors; a) a power consumed by the compressors to create this pressure; b) a significant impact of the charging pressure on the air thermodynamic properties at the stage of air deep cooling (as shown above in the FIGS. 3 and 4); and c) a negligible impact of the charging pressure on the air liquefaction ratio at a selected value of target air temperature. In addition, a value of the pressure drop in the intercoolers 102, 106, 110 and aftercooler 114 and filter 117 must be taken into account. With regard to all the mentioned considerations and in accordance with the present disclosure, a selected value of air charging pressure at the last compressor outlet shall exceed its critical point by 2-4 bar at most.

The following equipment packages 200, 300 and 400 taken together present a deep cooling system, intended for: a) a deep cooling of the charging air stream and its liquefaction at the charging pressure during the energy storage charging; and b) a preheating and regasification of pumped discharged air stream at the selected pressure during energy storage discharging. The equipment package 500 is intended to complete the liquefaction of a part of the charging air stream, separate the liquid and vapor phases of this stream during the energy storage charging, store a liquid phase between the energy storage charging and discharging at the practically atmospheric pressure, and pump a liquid air as a discharged stream for its preheating and regasification during the energy storage discharging.

A set of the cold exchangers 203, 303, 304 and 403 and a set of the cold storages 202, 302 and 402 can form a deep cooling system and can be used during energy storage charging. The passing of the charging air stream through this system results in reducing the air temperature at the system outlet down to a selected value and in full air liquefaction at a selected temperature and a pressure, which is less than the air charging pressure by a value of pressure drop in the aftercooler 114, filter 117, and deep cooling system. A throttling device 501 installed at the deep cooling system outlet is intended to isenthalpically expand a deeply cooled charging air stream down to a practically atmospheric pressure and vaporize a lesser part of the charging air stream at this pressure. In turn, a separator 502 installed downstream of the throttling device 501 is intended to separate the liquid and vapor air phases of the charging air stream and to produce the liquid air from the most part of this stream, resulting in achieving a target air liquefaction ratio at a practically atmospheric pressure. A vapor stream is vented into atmosphere in direction opposite to charging air stream through the cold exchangers 203, 303 and 403 of the third 400, second 300 and first 200 stages of the deep cooling system. A cold capacity of vent vapor stream can provide at least a portion of the cold capacity of the system, which may be desired for deep cooling the charging air stream. A liquid phase of the charging air stream is delivered from the separator 502 into a liquid air storage tank 503 for storing between the energy storage charging and discharging. In some embodiments, selection of the charging air stream temperature at the outlet of the third stage 400 of deep cooling system and at the inlet of the throttling device 501 is recommended in the range from −170° C. to −180° C. at a pressure, which is less than air charging pressure by a value of pressure drop in the aftercooler 114, filter 117, and deep cooling system 200, 300 and 400. This along with a design of deep cooling system as proposed in the present disclosure makes it possible to reach a target air liquefaction ratio in the throttling device 501 in the range from 75 to 85%, corresponding a relationship (25% -15%):(75%-85%) between a lesser (vent vapor) and the most (stored liquid) phases of the charging air stream at a practically atmospheric pressure.

During energy storage, discharging a cold storage medium contained in the storages 202, 302 and 402 exchanges thermal energy with the discharged air stream, resulting in heating this stream and cooling a cold storage medium. During energy storage, charging a cold storage medium exchanges thermal energy with the charging air stream, resulting in cooling this stream and heating a cold storage medium. In such a manner the cold storages can provide a significant portion of the cold capacity desired for deep cooling the charging air stream during the energy storage charging. A set of cold heat exchangers 203, 303 and

403 provide exchange of thermal energy between the charging and vent vapor streams through cooling the first and heating the second. This makes it possible to provide for a portion of the cold capacity, as desired for deep cooling the charging air stream during the energy storage charging. However, as discussed above, a combined cold capacity of two internal cold sources (the vent vapor stream and cold storage medium) is less than it is desired for achievement of the selected temperature of the charging air stream at the outlet of deep cooling system. Therefore there may be a desire for an external cold source, eliminating the above-mentioned deficit in cold capacity. This leads however to increase in power consumed during energy storage charging.

To minimize consumption of a power from the grid during energy storage charging for achievement of a target air liquefaction ratio a special method of the deep cooling the charging air is proposed. According to some embodiments, the cooling of charging air stream in a deep cooling system is performed in three sequential stages, wherein the air temperature is progressively reduced from a temperature at the outlet of an aftercooler 114 down to a selected temperature at the inlet of throttling device 501. A temperature of the charging air stream at the outlet of the first stage 200 and inlet of the second stage 300 is maintained close to a value at which air heat capacity achieves its maximum value in the process of air deep cooling at the charging pressure. Thereby a temperature of the charging air stream at the outlet of the second stage 300 and inlet of the third stage 400 shall be below the second stage inlet temperature by 1.5-38.5° C., depending on a target air liquefaction ratio and a selected value of discharged air pressure. Other factors being equal, a temperature interval for the second stage of the deep cooling system should be increased within the diapason with increase in the target air liquefaction ratio and pressure of discharged air stream.

A design of a deep cooling system can also include a controlled splitter 201 to split the charging air stream at the inlet of the first stage 200 of deep cooling system into two parallel streams, providing in-parallel passing the first stream through the first cold exchanger 203 in the direction opposite to a vent vapor stream and the second stream through the first cold storage 202, resulting in the same outlet temperature of both streams combined at the outlet of the first stage.

In addition, a design of a deep cooling system includes a controlled splitter 301 of the charging air stream at the inlet of the second stage 300 of deep cooling system to split the air stream into three parallel streams, providing in-parallel passing the first stream through the second cold exchanger 303 in the direction opposite to a vent vapor stream, the second stream through the second cold storage 302 and the third stream through a balance cold exchanger 304 being serviced by an external cold source, resulting in the same outlet temperature of all streams combined at the outlet of the second stage.

Finally, a design of a deep cooling system includes a controlled splitter 401 of the charging air stream at the inlet of the third stage 400 of deep cooling system to split the air stream into two parallel streams, providing in-parallel passing the first stream through the third cold exchanger 403 in the direction opposite to a vent vapor stream, and the second stream through the third cold storage 402, resulting in the same outlet temperature of both streams combined at the outlet of the third stage.

A controlled splitter 201 of the charging air stream at the inlet of the first stage 200 of deep cooling system can provide the optimal mass flow relationship between the first and second streams as (9%-17%):(91%-83%) in the diapasons of the charging and discharged air pressures and selected temperature at the deep cooling system outlet.

A controlled splitter 301 of the charging air stream at the inlet of the second stage 300 of deep cooling system can provide the optimal mass flow relationship between the first, second and third streams as (3%-8%):(20%-51%):(46%-76%) in the diapasons of the charging and discharged air pressures and selected temperature at the deep cooling system outlet.

A controlled splitter 401 of the charging air stream at the inlet of the third stage 400 of deep cooling system can provide the optimal mass flow relationship between the first and second streams as (9%-57%):(91%-43%) in the diapasons of the charging and discharged air pressures and selected temperature at the deep cooling system outlet.

The proposed method provides a deep cooling of the charging air stream at the first 200 and third 400 stages using mainly or exclusively the cold capacities of the vent vapor stream and cold storage medium, whereas at the second stage 300 with use of the internal cold capacities supplemented by a cold capacity of the external cold source 305, ensuring from 45 to 80% of a cold capacity required at the second stage and from 3 to 18% of a total cold capacity required in the deep cooling process as a whole.

An external cold source may be designed in the form of balance cold generator 305 consuming a power from the grid or any other source during energy storage charging and using the well-known mixed refrigerant or turbo-expander technologies for supplying a balance cold exchanger 304 at the second stage 300 of deep cooling system with an appropriate cold carrier.

As an appropriate cold carrier, a liquefied natural gas, circulating in a closed loop between the balance cold generator 305 and balance cold exchanger 304 and providing phase-change heat transfer in this cold exchanger, may be used.

An external cold source may be alternatively designed in the form of any source of liquefied natural gas delivered into a balance cold heat exchanger 304 in the liquid form and captured from this cold exchanger and delivered to any consumers in the gaseous form.

As a cold storage medium, a liquid propane, providing a convective indirect exchange of thermal energy with the charging air stream during energy storage charging and with the discharged air stream during energy storage discharging, may be used. For this purpose the cold storages 202, 302 and 402 are integrated with the appropriate cold exchangers (not shown in the FIG. 6-8), wherein a convective indirect exchange of thermal energy is performed between the charging air stream and a propane during energy storage charging and between the discharged air stream and a propane during energy storage discharging.

As an alternative cold storage medium, a cold storage medium in the form of a pebble, providing direct exchange of thermal energy with the charging air stream during energy storage charging and with the discharged air stream during energy storage discharging, may be used.

During energy storage discharging, a liquid air pump 504 consumes the required power from the grid or any other external sources to capture the liquid air from the storage tank 503, pumps it up to a discharged air pressure at the pump outlet, and forms the discharged air stream at the inlet of a deep cooling system in the direction opposite to one of the charging air stream during energy storage charging.

In some embodiments, a pressure of discharged air stream at the pump 504 outlet shall exceed a pressure of charging air stream at the outlet of last compressor.

The passing of the discharged air stream through a set of the cold storages 402, 302 and 202 leads to a progressive increase in temperature of the passing discharged air and full its regasification, resulting from an exchange of thermal energy between the discharged air stream and cold storage medium. As described above, this process is divided into three stages 400, 300 and 200 and conducted in three said cold storages. A full stream of discharged air passes sequentially through these cold storages during discharging process, whereas a mass flow of the charging air stream directed into each of the cold storages during charging process is changed as described above in accordance with the given and selected process data.

A superheater 601 of the discharged air stream integrated with the heat storage 115 is intended to further increase a discharged air temperature during energy storage discharging through use of the heat extracted from the charging air stream in the aftercooler 114 during energy storage charging and accumulated in the heat storage 115.

A superheated discharged air stream is directed to the first 602 of the four air expanders at a pressure which is less than discharging pressure by a value of pressure drop in the deep cooling system 400, 300 and 200 and a superheater 601. The passing of the discharged air stream through the first 602 and succeeding 603, 604 and 605 expanders is accompanied by a gradual decrease in its pressure down to the atmospheric at the outlet of last expander 605 and by a corresponding decrease in air temperature at the outlet of each expander.

A set of the discharged air stream reheaters 606, 607 and 608 integrated with the heat storages 111, 107 and 103 is intended to increase the air temperature at the inlet of each expander during energy storage discharging through use of the heat extracted from the charging air stream in the intercoolers 110, 106 and 102 during the energy storage charging and accumulated in the heat storages 111, 107 and 103.

A power produced by the expansion of the discharged air stream in the plurality of air expanders 602, 603, 604 and 605 during energy storage discharging is delivered into the grid or any other consumers.

In the first embodiment, a plurality of air expanders 602, 603, 604 and 605 and a set of the discharged air superheater 601 and reheaters 606, 607 and 608 are designed in such a way to provide a temperature of passing air at the outlet of last expander 605 close to ambient air temperature.

Figure 7:
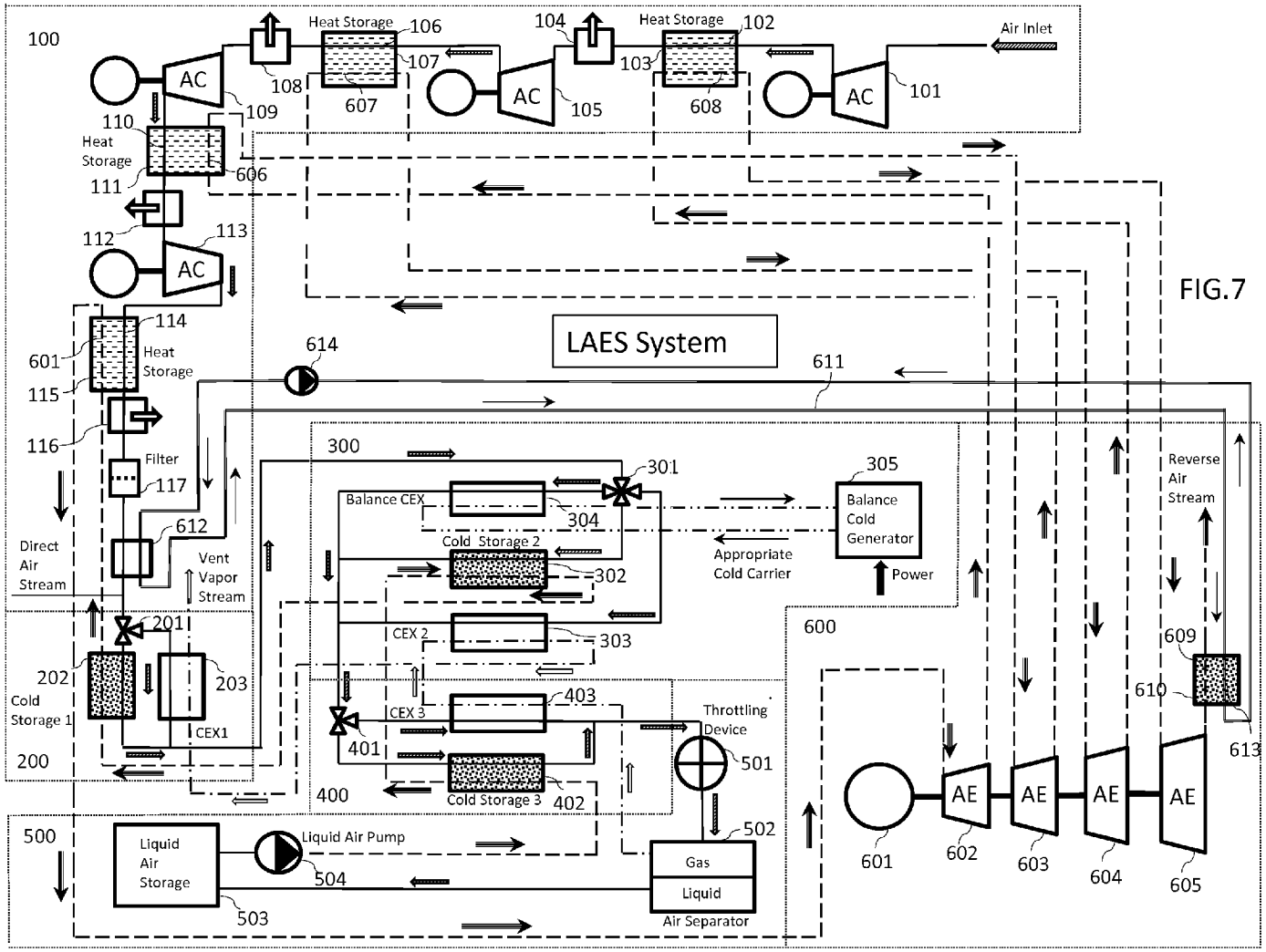
FIG. 7 shows a system realizing the proposed method of energy storage and recovery in accordance with a second embodiment.

FIG. 7 shows a system realizing the proposed method of energy storage and recovery in accordance with a second embodiment. In the second embodiment of the system for realization of proposed method shown in the FIG. 7, the plurality of air expanders 602, 603, 604 and 605 and the set of the discharged air stream superheater 601 and reheaters 606, 607 and 608 are designed in such a way to provide a temperature of discharged air stream at the outlet of last expander 605 markedly below ambient air temperature.

In this embodiment, a discharged air stream escaping the last air expander may be equipped with a thermal energy exchanger 609, intended to provide an exchange of thermal energy between the air stream and a thermal energy storage medium, accompanied by heating an exhausted discharged stream up to temperature slightly below ambient air temperature. A thermal energy storage 610, filled with this medium and intended to accumulate extracted thermal energy and store it between the energy storage discharging and charging, is integrated with the thermal energy exchanger 609.

An extracted, accumulated and stored thermal energy of the discharged air stream at the outlet of the last expander during energy storage discharging can be used through a thermal energy recovery system for precooling the charging air stream at the inlet of a deep cooling system during the energy storage charging. The thermal energy recovery system can consist of: a) a closed loop 611 of an intermediate thermal energy carrier; b) a charging air precooler 612 installed at the inlet of the deep cooling system and intended to provide an exchange of thermal energy between the charging air stream and intermediate thermal energy carrier; c) a thermal energy exchanger 613 intended to provide an exchange of thermal energy between a thermal energy storage medium and an intermediate thermal energy carrier; and d) a means 614 for pumping an intermediate thermal energy carrier.

Figure 8:
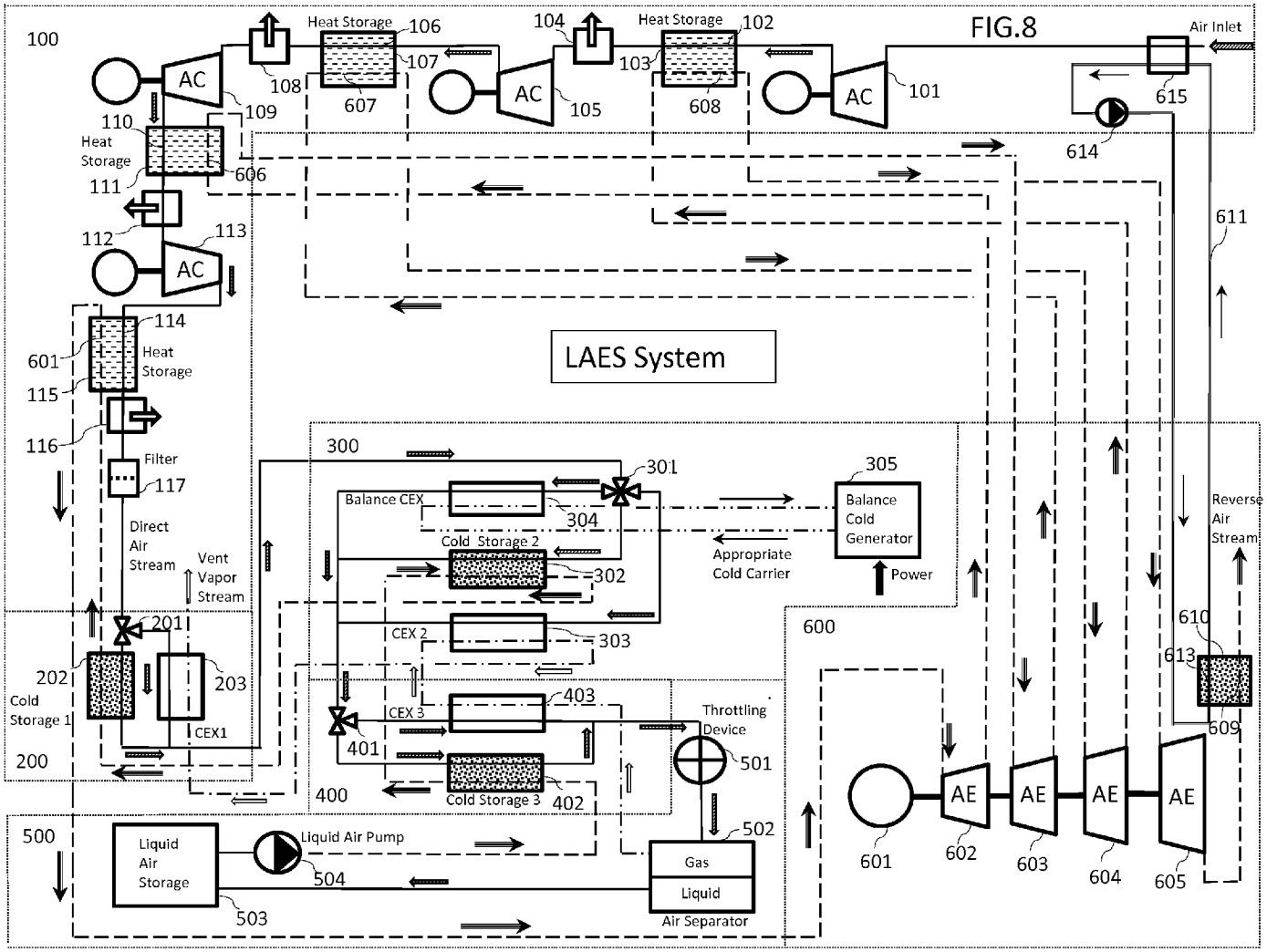
FIG. 8 shows a system realizing the proposed method of energy storage and recovery in accordance with a third embodiment.

FIG. 8 shows a system realizing the proposed method of energy storage and recovery in accordance with a third embodiment. In the third embodiment of the system for realization of proposed method shown in the FIG. 8, the plurality of air expanders 602, 603, 604 and 605 and a set of the discharged air superheater 601 and reheaters 606, 607 and 608 are designed in such a way to provide a temperature of discharged air stream at the outlet of last expander 605 markedly below ambient air temperature.

In this embodiment, a discharged air stream escaping the last air expander may be equipped with a thermal energy exchanger 609, intended to provide an exchange of thermal energy between the stream and a thermal energy storage medium, accompanied by heating an exhausted discharged stream up to temperature slightly below ambient air temperature. A thermal energy storage 610, filled with this medium and intended to accumulate an extracted thermal energy and store it between the energy storage discharging and charging, is integrated with the thermal energy exchanger 609.

An extracted, accumulated and stored thermal energy of the discharged air stream at the outlet of the last expander during energy storage discharging is used through a thermal energy recovery system for chilling the charging air stream at the inlet of the first compressor during the energy storage charging. The thermal energy recovery system can consist of: a) a closed loop 611 of an intermediate thermal energy carrier; b) a charging air chiller 615 installed at the inlet of the first compressor and intended to provide an exchange of thermal energy between the charging air stream and intermediate thermal energy carrier; c) a thermal energy exchanger 613 intended to provide an exchange of thermal energy between a thermal energy storage medium and an intermediate thermal energy carrier; and d) a means 614 for pumping intermediate thermal energy carrier inside the closed loop 611.

Finally, in the fourth embodiment of the system (not shown in the drawing) the means for recovering any waste heat from the external energy sources for superheating the discharged air stream at the inlet of the first expander and for reheating the discharged air stream at the inlet of other expanders may be applied.

In one or more embodiments of the disclosed subject matter, non-transitory computer-readable storage media and a computer processing systems can be provided. In one or more embodiments of the disclosed subject matter, non-transitory computer-readable storage media can be embodied with a sequence of programmed instructions for controlling solar power with Liquid Air Energy Storage (LAES), the sequence of programmed instructions embodied on the computer-readable storage medium causing the computer processing systems to perform one or more of the disclosed methods.

It will be appreciated that the modules, processes, systems, and devices described above can be implemented in hardware, hardware programmed by software, software instruction stored on a non-transitory computer readable medium or a combination of the above. For example, a method for controlling energy storage and recovery can be implemented, for example, using a processor configured to execute a sequence of programmed instructions stored on a non-transitory computer readable medium. For example, the processor can include, but is not limited to, a personal computer or workstation or other such computing system that includes a processor, microprocessor, microcontroller device, or is comprised of control logic including integrated circuits such as, for example, an Application Specific Integrated Circuit (ASIC). The instructions can be compiled from source code instructions provided in accordance with a programming language such as Java, C++, C#.net or the like. The instructions can also comprise code and data objects provided in accordance with, for example, the Visual Basic™ language, LabVIEW, or another structured or object-oriented programming language. The sequence of programmed instructions and data associated therewith can be stored in a non-transitory computer-readable medium such as a computer memory or storage device which may be any suitable memory apparatus, such as, but not limited to read-only memory (ROM), programmable read-only memory (PROM), electrically erasable programmable read-only memory (EEPROM), random-access memory (RAM), flash memory, disk drive and the like.

Furthermore, the modules, processes, systems, and devices can be implemented as a single processor or as a distributed processor. Further, it should be appreciated that the steps mentioned herein may be performed on a single or distributed processor (single and/or multi-core). Also, the processes, modules, and sub-modules described in the various figures of and for embodiments herein may be distributed across multiple computers or systems or may be co-located in a single processor or system. Exemplary structural embodiment alternatives suitable for implementing the modules, sections, systems, means, or processes described herein are provided below.

The modules, processes, systems, and devices described above can be implemented as a programmed general purpose computer, an electronic device programmed with microcode, a hard-wired analog logic circuit, software stored on a computer-readable medium or signal, an optical computing device, a networked system of electronic and/or optical devices, a special purpose computing device, an integrated circuit device, a semiconductor chip, and a software module or object stored on a computer-readable medium or signal, for example.

Embodiments of the methods, processes, modules, devices, and systems (or their sub-components or modules), may be implemented on a general-purpose computer, a special-purpose computer, a programmed microprocessor or microcontroller and peripheral integrated circuit element, an ASIC or other integrated circuit, a digital signal processor, a hardwired electronic or logic circuit such as a discrete element circuit, a programmed logic circuit such as a programmable logic device (PLD), programmable logic array (PLA), field-programmable gate array (FPGA), programmable array logic (PAL) device, or the like. In general, any process capable of implementing the functions or steps described herein can be used to implement embodiments of the methods, systems, or computer program products (software program stored on a non-transitory computer readable medium).

Furthermore, embodiments of the disclosed methods, processes, modules, devices, systems, and computer program product may be readily implemented, fully or partially, in software using, for example, object or object-oriented software development environments that provide portable source code that can be used on a variety of computer platforms. Alternatively, embodiments of the disclosed methods, processes, modules, devices, systems, and computer program product can be implemented partially or fully in hardware using, for example, standard logic circuits or a very-large-scale integration (VLSI) design. Other hardware or software can be used to implement embodiments depending on the speed and/or efficiency requirements of the systems, the particular function, and/or particular software or hardware system, microprocessor, or microcomputer being utilized. Embodiments of the methods, processes, modules, devices, systems, and computer program product can be implemented in hardware and/or software using any known or later developed systems or structures, devices and/or software by those of ordinary skill in the applicable art from the function description provided herein and with a general basic knowledge of electricity generation, electricity storage systems, and/or computer programming arts.

Features of the disclosed embodiments may be combined, rearranged, omitted, etc., within the scope of the present disclosure to produce additional embodiments. Furthermore, certain features may sometimes be used to advantage without a corresponding use of other features.

It is thus apparent that there is provided in accordance with the present disclosure, systems, devices, and methods for energy storage and recovery. Many alternatives, modifications, and variations are enabled by the present disclosure. While specific embodiments have been shown and described in detail to illustrate the application of the principles of the present invention, it will be understood that the invention may be embodied otherwise without departing from such principles. Accordingly, Applicants intend to embrace all such alternatives, modifications, equivalents, and variations that are within the spirit and scope of the present invention.

We claim:

1. A method of liquid air energy storage and recovery comprising:

charging a liquid air energy storage (LAES) with power from a power source, the charging including storing thermal energy, discharging the LAES including generating electrical power by converting liquid air resulting from the charging and thermal energy resulting from the storing thermal energy, the discharging resulting in the withdrawal of thermal energy from a cold storage by discharged air, the discharged air, the charging including:

sequentially compressing charging air in a plurality of intercooled air compressors up to a charging pressure exceeding the air critical point;

storing, for recovery during the energy storage discharging, the compression heat extracted from pressurized charging air resulting from its intercooling and aftercooling in a compression heat storage;

deep cooling a charging air stream and its liquefaction, resulting from exchange of thermal energy with cold storage medium and a vent air stream;

expanding the liquefied charging air stream with succeeding separating the resulting liquid and gaseous phases of expanded stream;

cooling the charging air, using a vent stream, and storing a resulting liquid phase of the charging air at near atmospheric pressure in liquid air tank;

discharging the LAES, including:

pumping a discharged liquid air stream up to pressure exceeding a pressure of charging air at a final charging compressor outlet during charging;

preheating and vaporizing a liquid discharge air stream at least partially using thermal energy from the cold storage medium;

further preheating and superheating a discharged air stream using the stored compression heat from the compression heat storage; and expanding a resulting superheated discharge air stream, in a plurality of air expanders including reheating the expanded air stream using a stored compression heat;

wherein the charging includes compressing the inlet air in the plurality of the air compressors up to charging pressure exceeding its critical point at the last compressor outlet by 2-4 bar at most, wherein the discharging includes pumping the liquid air up to discharging pressure exceeding a charging air pressure, wherein the charging includes deep cooling the charging air stream down to a temperature at the deep cooling system outlet, selected in the range from -170° C. to -180° C. and allowing the resulting charging air stream to reach a target air liquefaction ratio in the range from 75 to 85% at a practically atmospheric pressure in the liquid air tank, wherein the charging includes conducting a process of deep cooling the charging air stream in first, second and third sequential stages, wherein the air temperature is progressively reduced from a temperature at the deep cooling system inlet down to a selected outlet temperature and wherein a temperature drop at the second stage reduces charging air temperature by 1.5-38.5° C., beginning from a temperature at which air heat capacity achieves its maximum value in a process of air deep cooling, wherein the charging includes dividing the charging air stream at the inlet of the first stage into two parallel streams and passing the first stream through the first cold exchanger in the direction opposite to a vent vapor stream and passing the second stream through a first portion of the cold storage, resulting in a same outlet temperature of both streams which are combined including simultaneously providing a mass-flow relationship between the first and second streams of (9%-17%) : (91%-83%), wherein the charging includes dividing the charging air stream at the inlet of the second stage into three parallel streams, providing in-parallel passing the first stream through the second cold exchanger in the direction opposite to a vent vapor stream, the second stream through the second cold storage and the third stream through a balance cold exchanger being serviced by an external cold source, resulting in the same outlet temperature of all streams combined at the outlet of the second stage, and simultaneously providing the optimal mass-flow relationship between the first, second and third streams of (3%-8%) : (20%-51%):(46%-76%), and wherein the charging includes dividing the charging air stream at the inlet of the third stage into two parallel streams, in-parallel passing the first stream through the third cold exchanger in the direction opposite to a vent vapor stream, and the second stream through the third cold storage, resulting in the same outlet temperature of both streams combined at the outlet of the third stage, and simultaneously providing mass-flow relationship between the first and second streams of (9%-57%): (91%-43%).

2. The method of claim 1, wherein the temperature drop at the second stage of charging air deep cooling is selected responsively to a target air liquefaction ratio and a selected pressure of discharged air stream according to predefined relationship characterized by an increase in the temperature drop with increasing these parameters.

3. The method of claim 1, further including a process of deep cooling the charging air stream at the first and third stages using exclusively the cold capacities provided by the vent vapor stream and cold storage medium, whereas at the second stage-using the internal cold capacities supplemented by a cold capacity of an external source, providing from 45 to 80% of a cold capacity required at this process stage and from 3 to 18% of a cold capacity required in the deep cooling process as a whole.

4. The method of claim 3, wherein the external cold source is used in the form of a balance cold generator producing an appropriate cold carrier and supplying a balance cold exchanger at the second stage of deep cooling process with this cold carrier.

5. The method of claim 4, wherein a liquefied natural gas is used as one of the appropriate cold carriers, circulating in a closed loop between a balance cold generator and a balance cold exchanger and providing phase-change heat transfer in this cold exchanger.

6. The method of claim 1, wherein the cold storage medium comprises a liquid propane and/or a pebble, the liquid propane being usable as the cold storage medium to provide a convective indirect exchange of thermal energy with the charging air stream during energy storage charging and with the discharged air stream during energy storage discharging, and the pebble being usable as the cold storage medium to provide a direct exchange of thermal energy with the charging air stream during energy storage charging and with the discharged air stream during energy storage discharging.

7. The method of claim 1, further comprising passing the discharged air stream through a plurality of air expanders and its reheating between the expanders in such a way that to provide a temperature of air at the last expander outlet close to ambient air temperature.

8. The method of claim 1, further comprising in combination:

passing the discharged air stream through a plurality of air expanders and its reheating between the expanders in such a way that to keep a temperature of air at the last expander outlet markedly below ambient air temperature;

extracting a cold thermal energy of the discharged air stream escaping the last air expander through its heating up to temperature slightly below ambient air temperature; and storing and following recovering an extracted cold thermal energy in the process of the energy storage charging.

9. The method of claim 8, wherein a charging air is subjected to one or both of:

chilling at the inlet of the first of the plurality of air compressors using cold thermal energy extracted from the discharged air stream at the outlet of the last expander during energy storage discharging and stored between the storage discharging and charging; and precooling at the deep cooling system inlet using cold thermal energy extracted from the discharged air stream at the outlet of the last expander during energy storage discharging and stored between the storage discharging and charging.

10. The method of claim 1, further comprising recovering any waste heat from the external energy sources for preheating the discharged air stream at the inlet of the first expander and for reheating the discharged air stream at the inlet of other expanders.

11. A method of energy storage and recovery comprising in combination a process of charging the energy storage with liquid air and thermal energy in the form of heat through consumption of power from the grid or any other source and a process of discharging the energy storage through conversion of the stored air and heat into power delivered into the grid or to any other consumer, accompanied by accumulation of cold extracted from discharged air and thereafter used in the process of energy storage charging, wherein the process of energy storage charging comprising in combination sequential compressing a charging air in the plurality of intercooled air compressors up to a charging pressure exceeding the air critical point; storing the compression heat extracted from the pressurized charging air in the processes of its intercooling and aftercooling for the following recovery during the energy storage discharging; deep cooling a charging air stream and its liquefaction, resulting from exchange of thermal energy with cold storage medium and a vent air stream; expanding the liquefied charging air stream with succeeding separating the resulting liquid and gaseous phases of expanded stream; recovering a cold of gaseous phase (vent stream) and storing a liquid phase of the charging air at a practically atmospheric pressure in liquid air tank, wherein the process of energy storage discharging comprising in combination pumping a discharged liquid air stream up to pressure exceeding a pressure of charging air at the last compressor outlet; preheating and regasification of a discharged air stream, resulting from exchange of thermal energy with cold storage medium; further preheating and superheating a discharged air stream using the stored compression heat; and expanding a superheated discharged air stream in the plurality of air expanders with reheating the expanded air stream using a stored compression heat, and wherein the improvement in the method comprising in combination:

compressing the inlet air in the plurality of the air compressors up to charging pressure exceeding its critical point at the last compressor outlet by 2-4bar at most;

pumping the liquid air up to discharging pressure exceeding a charging air pressure;

deep cooling the charging air stream down to a temperature at the deep cooling system outlet, selected in the range from −170° C. to −180° C. and allowing to reach a target air liquefaction ratio in the range from 75 to 85% at a practically atmospheric pressure in the liquid air tank;

conducting a process of deep cooling the charging air stream in three sequential stages, wherein the air temperature is progressively reduced from a temperature at the deep cooling system inlet down to a selected outlet temperature and wherein a temperature drop at the second stage reduces charging air temperature by 1.5-38.5° C., beginning from a temperature at which air heat capacity achieves its maximum value in a process of air deep cooling;

controlled dividing the charging air stream at the inlet of the first stage into two parallel streams, providing in-parallel passing the first stream through the first cold exchanger in the direction opposite to a vent vapor stream and the second stream through the first cold storage, resulting in the same outlet temperature of both streams combined at the outlet of the first stage, and simultaneously providing the optimal mass-flow relationship between the first and second streams as (9%-17%) : (91%-83%);

controlled dividing the charging air stream at the inlet of the second stage into three parallel streams, providing in-parallel passing the first stream through the second cold exchanger in the direction opposite to a vent vapor stream, the second stream through the second cold storage and the third stream through a balance cold exchanger being serviced by an external cold source, resulting in the same outlet temperature of all streams combined at the outlet of the second stage, and simultaneously providing the optimal mass-flow relationship between the first, second and third streams as (3%-8%) : (20%-51%) : (46%-76%); and controlled dividing the charging air stream at the inlet of the third stage into two parallel streams, providing in-parallel passing the first stream through the third cold exchanger in the direction opposite to a vent vapor stream, and the second stream through the third cold storage, resulting in the same outlet temperature of both streams combined at the outlet of the third stage, and simultaneously providing the optimal mass-flow relationship between the first and second streams as (9%-57%) : (91%-43%).

12. The method of claim 11, wherein selecting a temperature drop at the second stage of charging air deep cooling is performed in accordance with the target air liquefaction ratio and selected pressure of discharged air stream and requires an increase in said temperature drop with increasing these parameters.

13. The method of claim 11, further conducting a process of deep cooling the charging air stream at the first and third stages using exclusively the cold capacities, provided by the vent vapor stream and cold storage medium, whereas at the second stage-using the internal cold capacities supplemented by a cold capacity of an external source, providing from 45 to 80% of a cold capacity required at this process stage and from 3 to 18% of a cold capacity required in the deep cooling process as a whole.

14. The method of claim 13, wherein an external cold source is used in the form of a balance cold generator producing an appropriate cold carrier and supplying a balance cold exchanger at the second stage of deep cooling process with this cold carrier.

15. The method of claim 14, wherein a liquefied natural gas is used as one of the appropriate cold carriers, circulating in a closed loop between a balance cold generator and a balance cold exchanger and providing phase-change heat transfer in this cold exchanger.

16. The method of claim 11, wherein the cold storage medium comprises a liquid propane and/or a pebble, the liquid propane being usable as the cold storage medium to provide a convective indirect exchange of thermal energy with the charging air stream during energy storage charging and with the discharged air stream during energy storage discharging, and the pebble being usable as the cold storage medium to provide a direct exchange of thermal energy with the charging air stream during energy storage charging and with the discharged air stream during energy storage discharging.

17. The method of claim 11, further comprising passing the discharged air stream through a plurality of air expanders and its reheating between the expanders in such a way that to provide a temperature of air at the last expander outlet close to ambient air temperature.

18. The method of claim 11, further comprising in combination:

passing the discharged air stream through a plurality of air expanders and its reheating between the expanders in such a way that to keep a temperature of air at the last expander outlet markedly below ambient air temperature;

extracting a cold thermal energy of the discharged air stream escaping the last air expander through its heating up to temperature slightly below ambient air temperature; and storing and following recovering the extracted cold thermal energy in the process of the energy storage charging.

19. The method of claim 7, wherein a charging air is subjected to one or both of:

chilling at the inlet of the first of the plurality of air compressors using cold thermal energy extracted from the discharged air stream at the outlet of the last expander during energy storage discharging and stored between the storage discharging and charging; and precooling at the deep cooling system inlet using cold thermal energy extracted from the discharged air stream at the outlet of the last expander during energy storage discharging and stored between the storage discharging and charging.

20. The method of claim 11, further comprising recovering any waste heat from the external energy sources for preheating the discharged air stream at the inlet of the first expander and for reheating the discharged air stream at the inlet of other expanders.

* * * * *